US005590740A

United States Patent [19]

Mai

[11] Patent Number: 5,590,740

[45] Date of Patent: Jan. 7, 1997

[54] DESCENDING DEVICE FOR EMERGENT ESCAPE FROM A BUILDING

[76] Inventor: Shi-Chong Mai, 13, Shour Nan Kern, Nan Kern, Pei Pu Shang, Hsinchu Sheng, Taiwan

[21] Appl. No.: 370,422

[22] Filed: Jan. 9, 1995

[51] Int. Cl.[6] ..... A62B 1/10

[52] U.S. Cl. ..... 182/236; 182/71

[58] Field of Search ..... 182/236, 73, 71, 182/237, 239, 231, 75

[56] References Cited

U.S. PATENT DOCUMENTS

| | | | |
|---|---|---|---|
| 861,707 | 7/1907 | Cain | 182/42 |
| 931,040 | 8/1909 | Cooke | 182/43 |
| 1,141,995 | 6/1915 | Upton | 182/71 |
| 4,598,793 | 7/1986 | Lew | 182/42 |
| 4,702,348 | 10/1987 | Lew | 182/42 |
| 4,712,645 | 12/1987 | Sheh | 182/236 |

*Primary Examiner*—Alvin C. Chin-Shue
*Attorney, Agent, or Firm*—Morton J. Rosenberg; David I. Klein

[57] ABSTRACT

A power-free descending device for emergent escape from a building which comprises a frame having a hook engaged on the top thereof for hanging on fixed objects and having an opening on central bottom thereof, two partition boards vertically positioned in the frame to divide the frame into three sections, a principal shaft with a central spiral part for the winding of ropes, several friction plates separately positioned underneath the principal shaft and respectively supported by a spring, two plates with one hole in each plate for coupling with one end of the principal shaft to position the shaft, and a rope winding on the central spiral part of the shaft with both ends stretching from the opening of the frame. When escaping from a high building, people grasp one end of the rope and the shaft rolls intermittently and slowly under the influence of the spring and the resistance of friction plates. The descending speed is therefore slow and the people can safely escape from the building.

1 Claim, 5 Drawing Sheets

DESCENDING DEVICE FOR EMERGENT ESCAPE FROM A BUILDING

BACKGROUND OF THE INVENTION

The present invention is directed to a power-free descending device for emergent escape from a building.

The well-known escape device is usually driven by electricity. It is a disadvantage that the device will lose its function as electricity stops. In addition, the design of these devices is usually complicated, thereby being easy to be damaged and being expensive. If only using ropes to escape from high buildings, people must be strong enough. Moreover, it is difficult to control the descending speed and it is therefore very dangerous by merely using ropes as escape tools.

It is therefore an object of the invention to provide a power-free descending device for emergent escape from a building.

DESCRIPTION OF THE PREFERRED EMBODIMENTS

Figure 1:
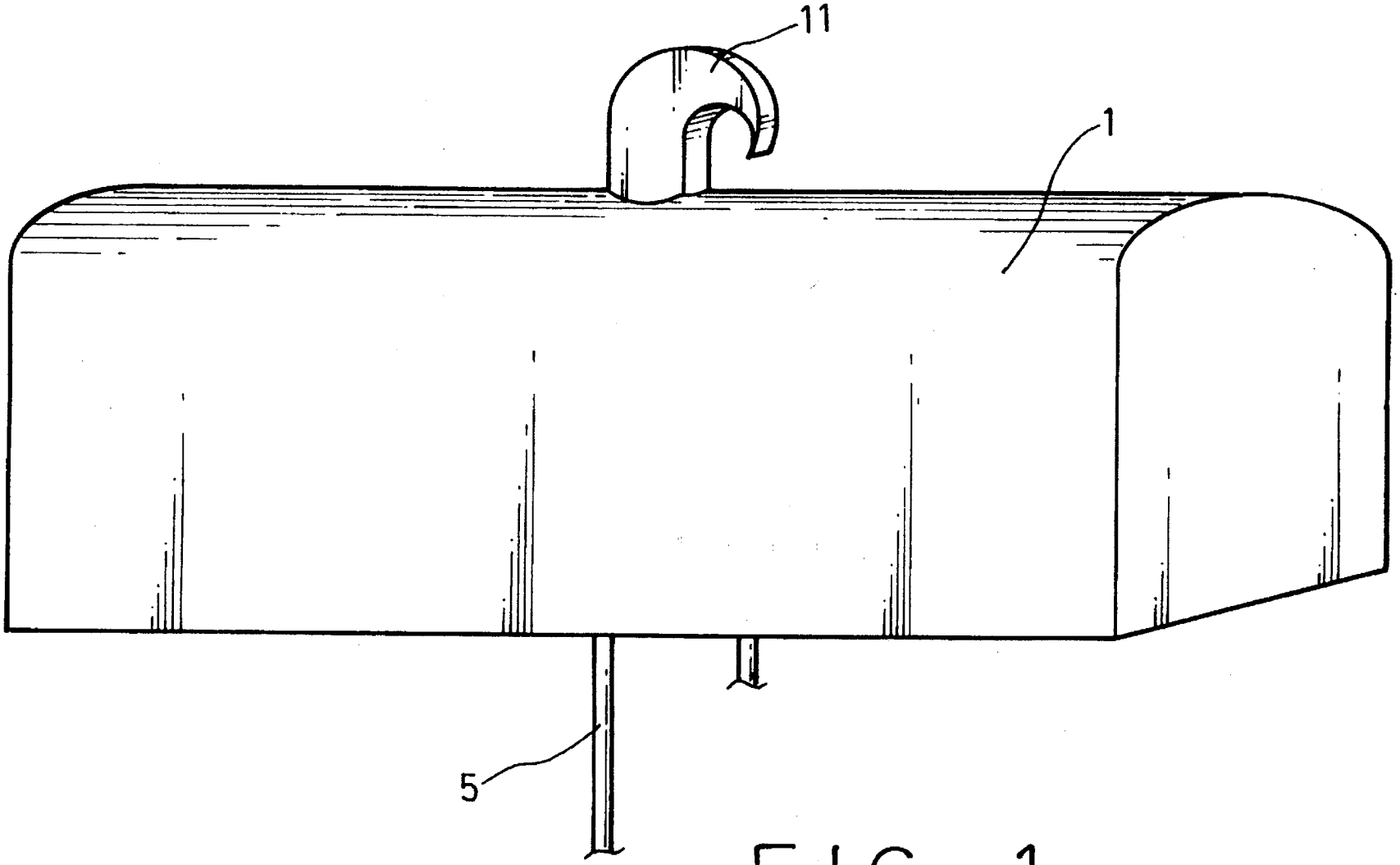
FIG. 1 is a perspective view of a descending device of the invention.
Figure 2:
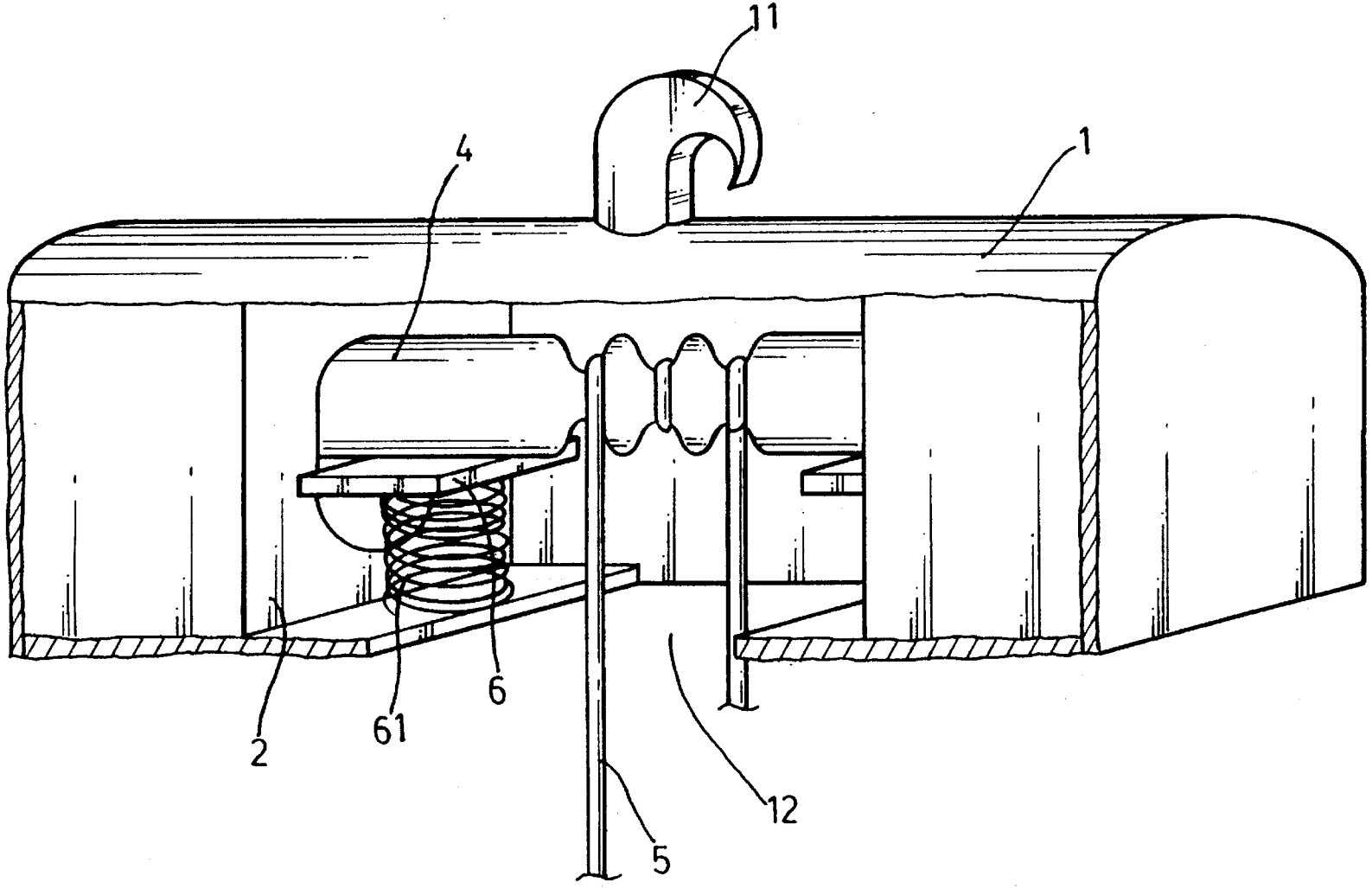
FIG. 2 is a perspective view, partially in section of FIG. 1.

As shown in FIGS. 1 to 4, a power-free descending device for emergent escape from a building comprises:

a frame 1, the frame 1 having a hook 11 engaged on the top thereof for hanging on fixed objects and having an opening 12 on central bottom thereof, two partition boards 2 vertically positioned in the frame 1 to divide the frame 1 into three sections with the right and left sections being symmetric each other, each board 2 having one hole 21 in the central part thereof, a principal shaft 4 with a central spiral part 42 for the winding of a rope 5, the shaft 4 being through the hole 21 of each partition board 2, two friction plates 3 and two friction plates 6 separately positioned underneath the shaft 4, each plate 3 or 6 being supported by a spring 31 or 61, the other end of the spring 31 or 61 being against on the bottom of the frame 1, two plates 41 with one hole in each plate 41 for coupling with one end of the shaft 4 to position the shaft 4, a rope 5 winding on the central spiral part 42 of the shaft 4 with both ends of the rope 5 stretching from the opening 12 of the frame 1.

Figure 3:
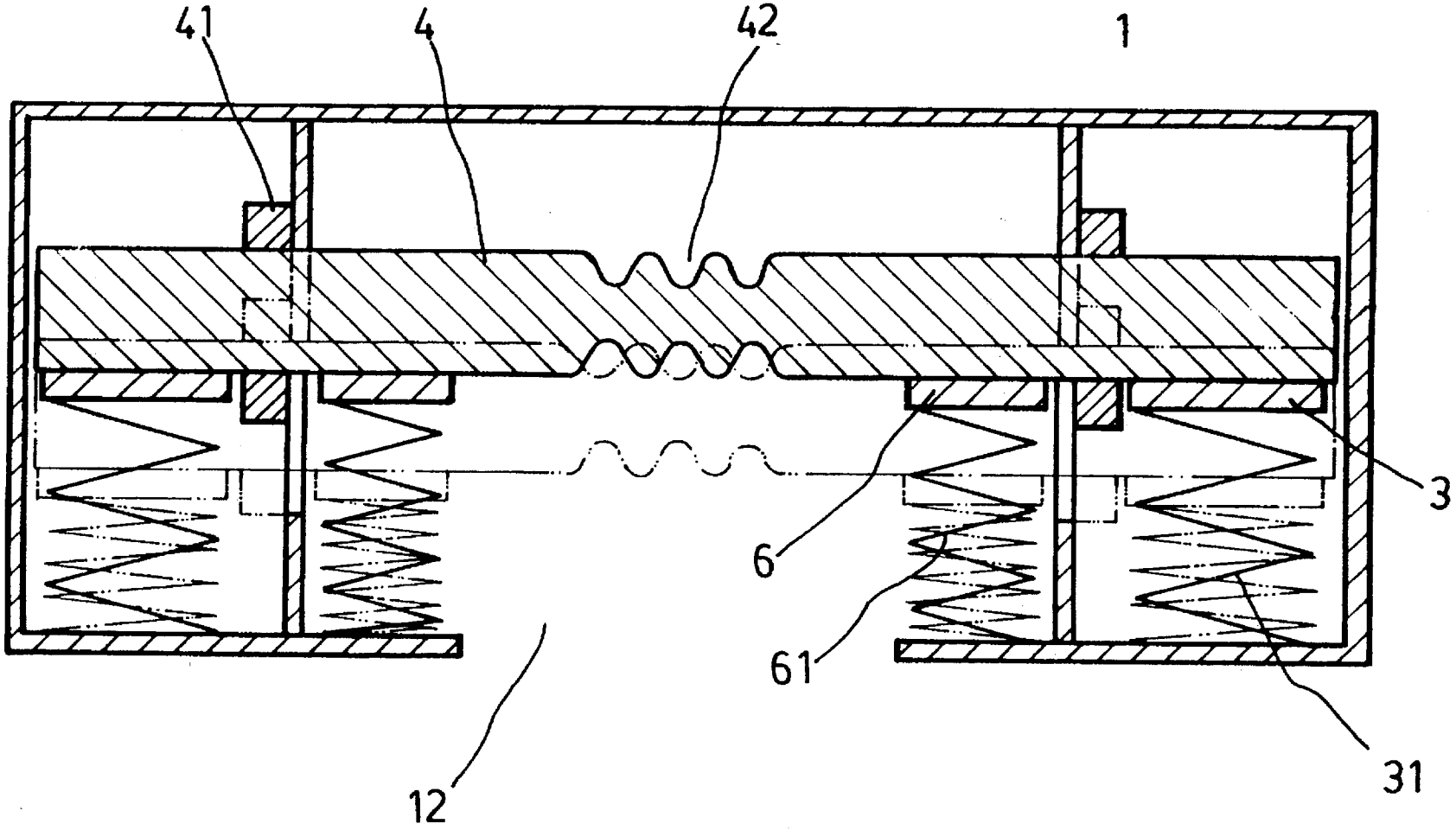
FIG. 3 is a cross-sectional view of a descending device of the invention.
Figure 4:
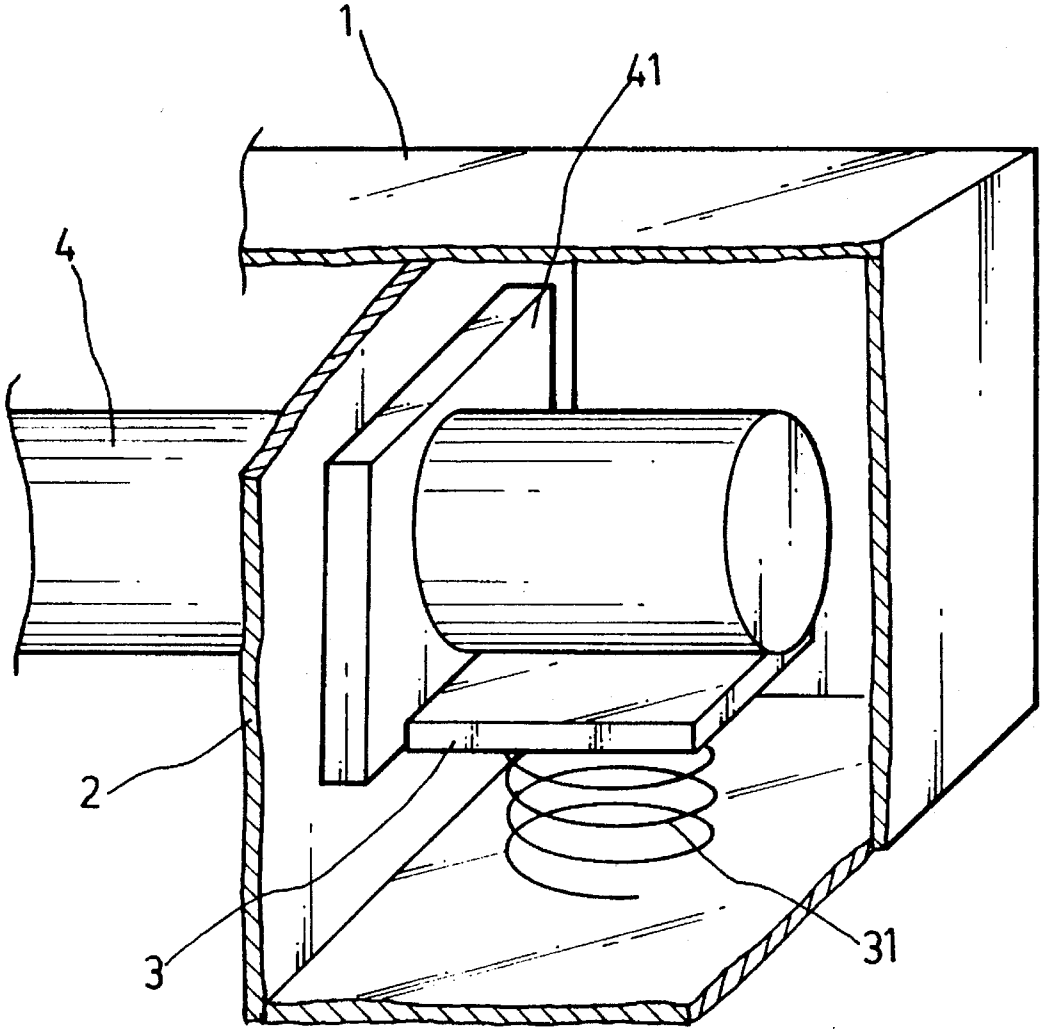
FIG. 4 is an enlarged partial perspective view of FIG. 1.
Figure 5:
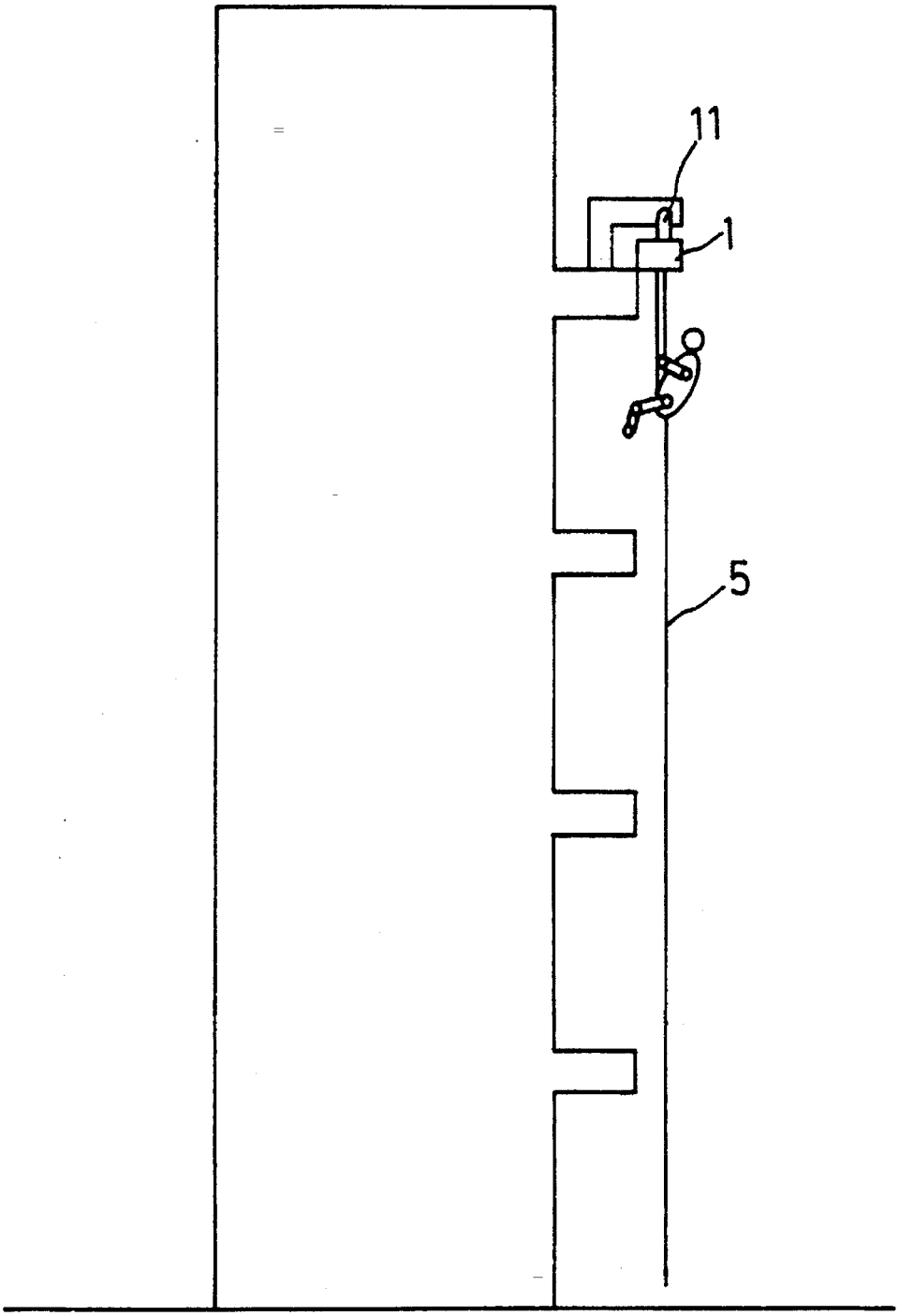
FIG. 5 is a plan view of an embodiment of the invention.

As shown in FIGS. 3 and 5, when escaping from a high building, the people grasps one end of the rope 5. The shaft 4 then rolls intermittently and is pulled down because of the weight of the people. As shown in FIG. 4, the shaft 4 will be pulled down to a level where the spring 31 is compressed to a limit. The shaft 4 rolls slowly under the influence of resistance of friction plates 3 and 6. The descending speed is therefore slow and the people can safely escape from the building.

I claim:

1. A descending device for emergent escape from a building comprising:

a frame, the frame having a hook engaged on the top thereof for hanging on fixed objects and having an opening on central bottom thereof, two partition boards vertically positioned in the frame to divide the frame into three sections with the right and left sections being symmetric each other, each board having one hole in the central part thereof, a principal shaft with a central spiral part for the winding of ropes, the principal shaft being through the hole of each partition board, several friction plates separately positioned underneath the principal shaft, each plate being supported by a spring, the other end of the spring being against on the bottom of the frame, two plates with one hole in each plate for coupling with one end of the principal shaft to position the shaft, and a rope winding on the central spiral part of the shaft with both ends of the rope stretching from the opening of the frame.

* * * * *